US011131956B2

(12) United States Patent
Okamoto

(10) Patent No.: US 11,131,956 B2
(45) Date of Patent: Sep. 28, 2021

(54) IMAGE FORMING APPARATUS INCLUDING WASTE DEVELOPER CONTAINER

(71) Applicant: KYOCERA Document Solutions Inc., Osaka (JP)

(72) Inventor: Kazuhiro Okamoto, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/171,378

(22) Filed: Feb. 9, 2021

(65) Prior Publication Data

US 2021/0255575 A1 Aug. 19, 2021

(30) Foreign Application Priority Data

Feb. 14, 2020 (JP) ..... JP2020-023015

(51) Int. Cl.

| | |
|---|---|
| ***G03G 15/08*** | (2006.01) |
| ***G03G 21/12*** | (2006.01) |
| ***B65H 1/26*** | (2006.01) |
| ***G03G 21/10*** | (2006.01) |

(52) U.S. Cl.

CPC ..... *G03G 21/12* (2013.01); *B65H 1/266* (2013.01); *G03G 21/105* (2013.01)

(58) Field of Classification Search

CPC ..... G03G 21/12; G03G 21/105; B65H 1/266

See application file for complete search history.

(56) References Cited

U.S. PATENT DOCUMENTS

| | | | | |
|---|---|---|---|---|
| 2014/0133890 | A1* | 5/2014 | Mitsui | G03G 15/0865 399/262 |
| 2016/0124350 | A1* | 5/2016 | Tomoe | G03G 15/6511 399/316 |
| 2020/0033752 | A1* | 1/2020 | Kubo | G03G 15/0856 |

FOREIGN PATENT DOCUMENTS

| | | |
|---|---|---|
| JP | 2018-066789 | 4/2018 |

* cited by examiner

*Primary Examiner* — Clayton E. LaBalle
*Assistant Examiner* — Michael A Harrison
(74) *Attorney, Agent, or Firm* — Lex IP Meister, PLLC

(57) ABSTRACT

An image forming apparatus includes a sheet cassette, a waste developer container, a capacitance sensor, a partition conductor, and a state determination unit. The waste developer container is disposed adjacent to the sheet cassette, and the capacitance sensor is disposed between the waste developer container and the sheet cassette. The partition conductor partitions between the sheet in the sheet cassette and the capacitance sensor, and is grounded. The state determination unit determines an amount of the waste developer in the developer container, based on a detection signal of the electrostatic capacitance sensor.

5 Claims, 6 Drawing Sheets

IMAGE FORMING APPARATUS INCLUDING WASTE DEVELOPER CONTAINER

This application is based upon and claims the benefit of priority from the corresponding Japanese Patent Application No. 2020-023015 filed on Feb. 14, 2020, the entire contents of which are incorporated herein by reference.

The present disclosure relates to an image forming apparatus including a waste developer container that stores waste developer.

BACKGROUND

Generally, an electrophotographic image forming apparatus includes a waste developer container that stores powdery waste developer collected from the image forming apparatus that forms an image on a sheet. The waste developer container is detachably attached to an attachment portion of a main body that houses the printer. The waste developer container is, for example, a bottle having an opening at one end in a longitudinal direction."

The image forming apparatus further includes a developer sensor configured to detect an amount of the waste developer in the waste developer container. When the developer sensor detects a full state of the waste developer container, a predetermined notification is issued to prohibit the printer from performing a printing process. The notification prompts a user to replace the waste developer container.

For example, it is known that the image forming apparatus includes a plurality of capacitance sensors that detect the amount of the waste developer at a plurality of positions in the waste developer container.

SUMMARY

An image forming apparatus according to an embodiment of the present disclosure includes a sheet cassette, a waste developer container, a capacitance sensor, a partition conductor, and a state determination unit. The sheet cassette stores sheet that is a medium on which an image is formed, and is supported so as to be capable of being pulled out from a predetermined fixed position. The waste developer container is disposed adjacent to the sheet cassette when the sheet cassette is located at the fixed position, and stores waste developer. The capacitance sensor is disposed between the waste developer container and the sheet cassette when the sheet cassette is present at the fixed position, and the partition conductor partitions between the sheet in the sheet cassette when the sheet cassette is present at the fixed position and the capacitance sensor, and the partition conductor is grounded. The state determination unit determines an amount of the waste developer in the waste developer container, based on a detection signal of the capacitance sensor.

DETAILED DESCRIPTION

Figure 1:
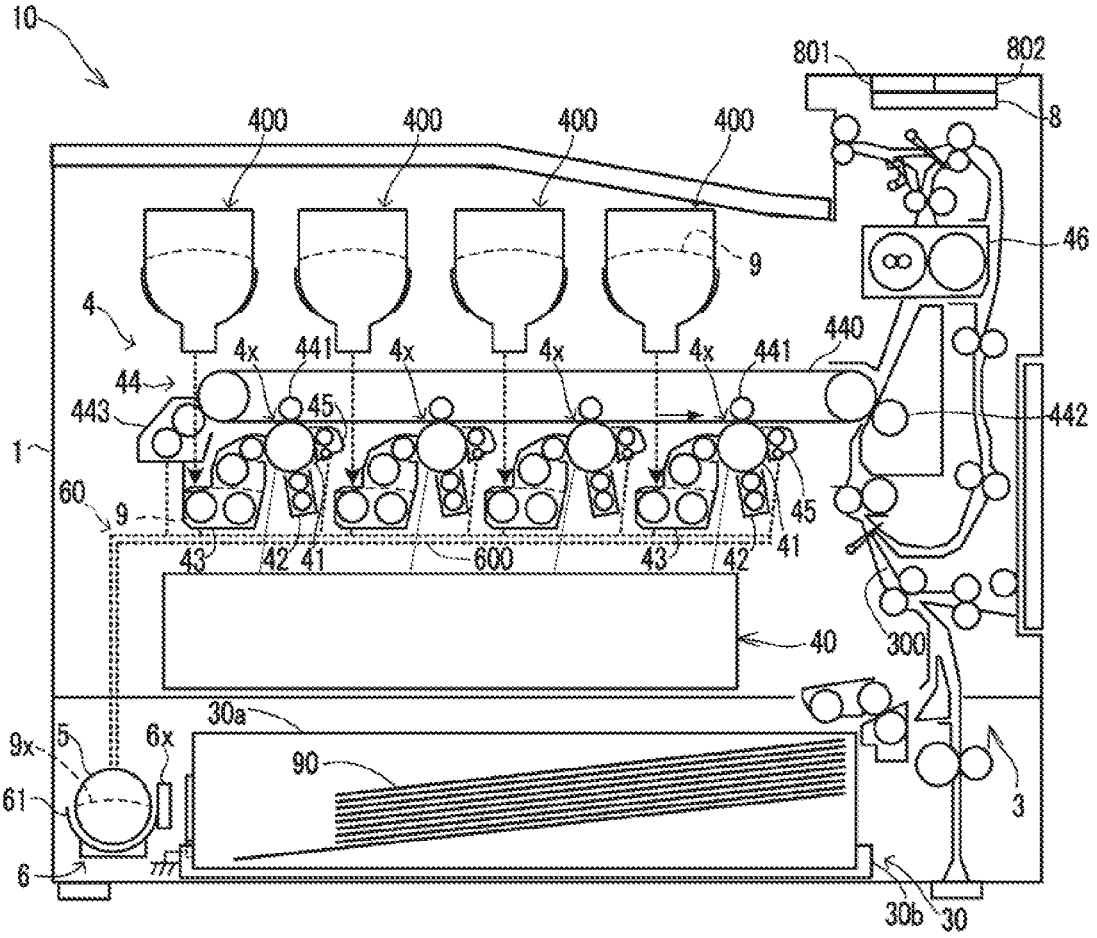
FIG. 1 is a configuration diagram of an image forming apparatus according to the present disclosure.

Hereinafter, embodiments of the present disclosure will be described with reference to the drawings. It should be noted that the following embodiment is a specific example of the present disclosure and does not limit the technical scope of the present disclosure.

[Configuration of Image Forming Apparatus 10]

An image forming apparatus 10 is an apparatus that forms a toner image on a sheet 90 by an electrophotographic method. The sheet 90 is a sheet-like image forming medium, such as paper or a resin film.

The image forming apparatus 10 includes a sheet storage part 30, a sheet conveying device 3, a printer 4, one or more toner containers 400, a bottle 5, and a waste developer collector 6, which are disposed in a main body 1. That is, the main body 1 includes the sheet conveying device 3, the printer 4, the one or more toner containers 400, the bottle 5, and the waste developer collector 6.

The sheet storage part 30 includes a sheet cassette 30*a* and a cassette support part 30*b*. The sheet cassette 30*a* stores the sheet 90 which is a medium on which an image is formed. The cassette support part 30*b* supports the sheet cassette 30*a* so that the sheet cassette 30*a* is drawable from the inside of the main body 1 to the front surface side of the main body 1.

Figure 4:
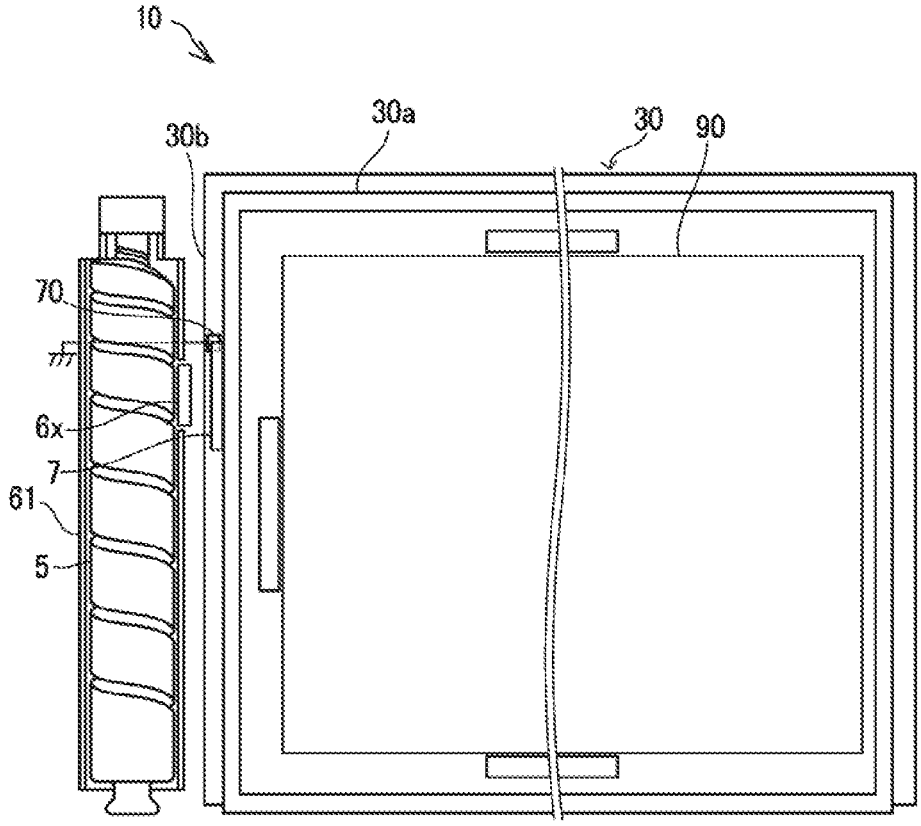
FIG. 4 is a configuration of a bottle attachment part and a sheet storage part in the image forming apparatus according to the present disclosure.
Figure 5:
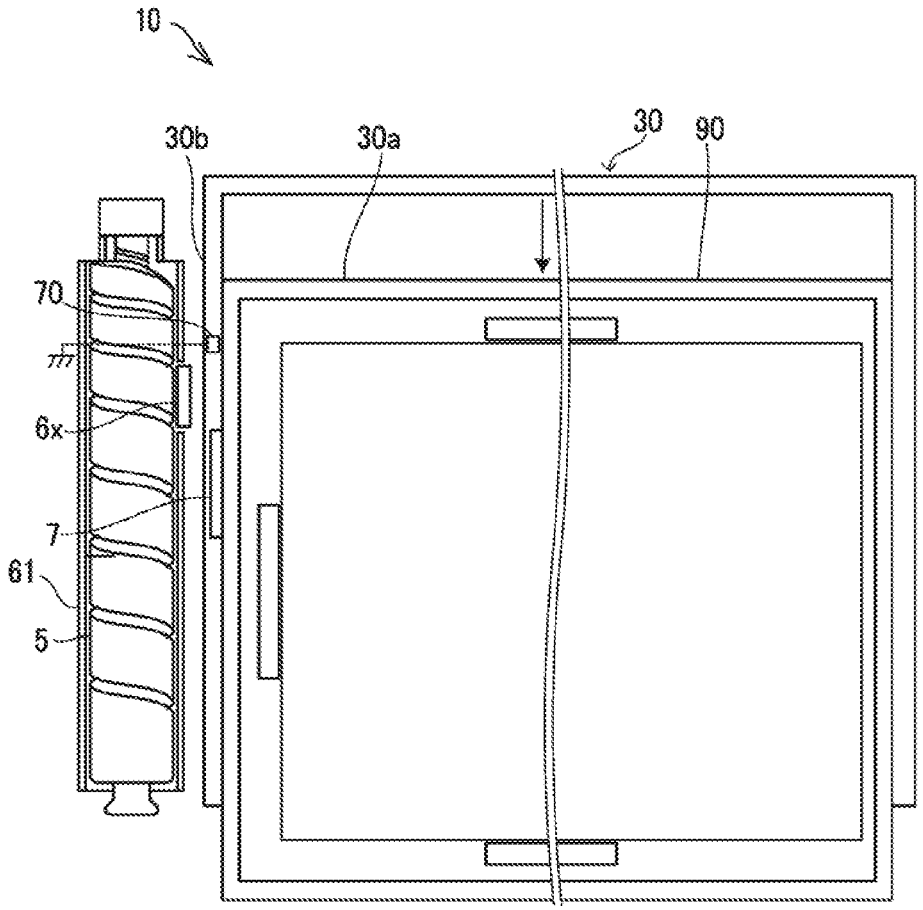
FIG. 5 is a diagram illustrating a bottle attachment part and the sheet storage part in a cassette pulled-out state in the image forming apparatus according to the present disclosure.

That is, the sheet cassette 30*a* is supported by the cassette support part 30*b* so as to be drawable from a predetermined fixed position in the main body 1 to the front side with respect to the fixed position. FIG. 4 shows a state in which the sheet cassette 30*a* is at the fixed position, and FIG. 5 shows a state in which the sheet cassette 30*a* is slightly pulled out from the fixed position.

The sheet conveying device 3 conveys the sheets 90 accommodated in the sheet cassette 30*a* one by one to a sheet conveying path 300, and further conveys the sheet 90 along the sheet conveying path 300.

The printer 4 executes a printing process of forming a toner image on the sheet 90 conveyed from the sheet cassette 30*a* by the sheet conveying device 3, by the electrophotographic method.

The printer 4 includes a laser scanning unit 40, one or more image forming devices 4*x*, a transfer device 44, and a fixing device 46.

In the example illustrated in FIG. 1, the printer 4 is a tandem type color image forming apparatus. Therefore, the printer 4 includes four toner containers 400 and the four image forming devices 4*x* corresponding to the four colors of toner 9. Each of the image forming devices 4*x* includes a photoconductor drum 41, a charging device 42, a developing device 43, and a drum cleaning device 45.

In each of the image forming devices 4*x*, the photoconductor drum 41 rotates, the charging device 42 charges the outer circumferential surface of the photoconductor drum 41, and the developing device 43 develops an electrostatic latent image formed on the outer circumferential surface of the photoconductor drum 41 by the laser scanning unit 40 into a toner image in each of the image forming devices 4*x*. The photoconductor drum 41 is an example of an image carrier.

The transfer device 44 further includes an intermediate transfer belt 440, four primary transfer devices 441, a secondary transfer device 442, and a belt cleaning device 443.

An intermediate transfer belt 440 rotates while being in contact with the four photoconductor drums 41, and the four primary transfer devices 441 transfer the toner images from the four photoconductor drums 41 to the intermediate transfer belt 440.

The secondary transfer device 442 transfers the toner image on the intermediate transfer belt 440 to the sheet 90 being conveyed on the sheet conveying path 300. The belt cleaning device 443 removes waste toner from the intermediate transfer belt 440. In addition, the drum cleaning device 45 removes waste toner remaining on the outer peripheral surface of the photoconductor drum 41 in each of the image forming devices 4*x*.

The fixing device 46 fixes the toner image on the sheet 90 by applying heat and pressure to the toner image on the sheet 90. The sheet conveying device 3 discharges the sheet 90 on which the image is formed from the sheet conveying path 300.

Each of the toner containers 400 supplies the toner 9 to the corresponding developing device 43 in the printer 4.

In the printer 4, the developing device 43 discharges powdery waste developer 9*x* containing waste toner retained for a long period of time. The drum cleaning device 45 and the belt cleaning device 443 discharge the removed waste developer 9*x*. The waste developer collector 6 collects the waste developer 9*x* discharged from the printer 4 into the bottle 5.

In a case where the developing device 43 performs development using a two-component developer containing the toner 9 and a carrier, the waste developer 9*x* also includes a waste carrier retained in the developing device 43 for a long period of time. In addition, the waste developer 9*x* may include the removed substances by the drum cleaning device 45 and the belt cleaning device 443 and the waste carriers.

Figure 2:
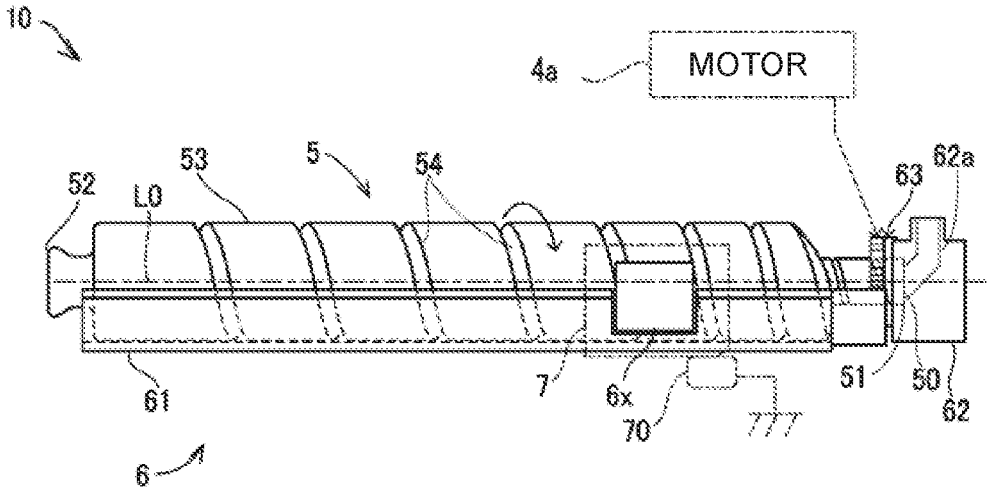
FIG. 2 is a configuration diagram of a bottle and a peripheral area thereof in the image forming apparatus according to the present disclosure.

As shown in FIG. 2, the bottle 5 is a vessel in which an opening 50 is formed at a first end 51 in a longitudinal direction. For example, the bottle 5 is made of synthetic resin. The bottle 5 has a cylindrical outer peripheral surface 53. A straight line along the longitudinal direction of the bottle 5 is a center line LO of the outer peripheral surface 53.

The bottle 5 has a spiral convex part 54 protruding spirally along the longitudinal direction on the inner surface, and the spiral convex part 54 is a spiral concave part when viewed from the outside of the bottle 5.

The bottle 5 is disposed in a state in which the longitudinal direction is horizontal, and is rotationally driven. Thereby the bottle 5 accommodates therein the waste developer 9*x* conveyed from the developing device 43 and the belt cleaning device 443 to the opening 50, and conveys the waste developer 9*x* therein toward a second end 52 in the longitudinal direction. The bottle 5 is an example of a waste developer container.

The image forming apparatus 10 further includes a control device 8, an operation device 801, and a display device 802. The operation device 801 is a touch panel, an operation button, or the like that receives a human operation. The display device 802 is a liquid crystal panel unit or the like that displays information.

Figure 3:
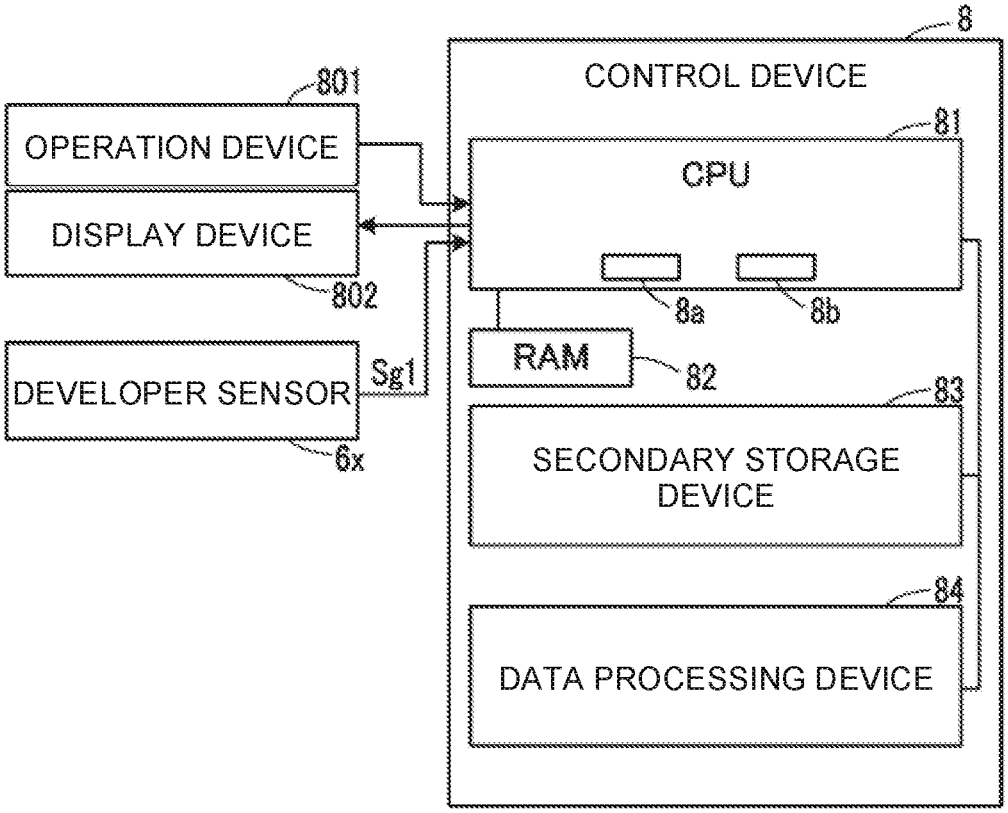
FIG. 3 is a block diagram illustrating a configuration of a control-related device in the image forming apparatus according to the present disclosure.

As shown in FIG. 3, the control device 8 includes a central processing unit (CPU) 81, random access memory (RAM) 82, a secondary storage device 83, an image data processing device 84, and the like.

The CPU 81 is an example of a processor that executes a program stored in the secondary storage device 83 or the like, to control electric devices in the image forming apparatus 10 and perform various types of data processing.

Note that another processor such as a digital signal processor (DSP) may execute various types of control and data processing instead of the CPU 81.

The RAM 82 is a storage device that temporarily stores the program to be executed by the CPU 81 and data to be output and referred to by the CPU 81 in the process of executing the program.

The secondary storage device 83 is a non-volatile computer-readable data storage device. The secondary storage device 83 can store the programs and various data. For example, one or a combination of both of a hard disk drive and a solid state drive (SSD) is employed as the secondary storage device 83.

The image data processing device 84 executes image processing such as processing or conversion on the image data used for the print processing. For example, the image data processing device 84 executes a process of converting print job data into raster data for printing.

For example, the image data processing device 84 is realized by one or both of a processor such as a DSP and an integrated circuit such as an application specific integrated circuit (ASIC).

[Waste developer collector 6]

As shown in FIGS. 1 and 2, the waste developer collector 6 includes a waste developer conveyance mechanism 60, a bottle attachment part 61, a carry-in relay part 62, and a bottle driving mechanism 63.

The bottle 5 accommodating the waste developer 9*x* is attached to the bottle attachment part 61. The bottle attachment part 61 is provided in the main body 1. The bottle 5 is disposed on the bottle attachment part 61 in a state in which the longitudinal direction is horizontal."

The waste developer conveyance mechanism 60 conveys the waste developer 9*x* discharged from the developing device 43 and the belt cleaning device 443 to the carry-in relay part 62 along the waste developer conveying path 600.

The carry-in relay part 62 is a member that forms a guide duct 62*a*. The carry-in relay part 62 guides the waste developer 9*x* conveyed into the guide duct 62*a* by the waste developer conveyance mechanism 60, to the opening 50 of the bottle 5 supported by the bottle attachment part 61.

The bottle driving mechanism 63 is coupled to the first end 51 of the bottle 5 supported by the bottle attachment part 61 and rotationally drives the bottle 5. A motor 4*a* that rotationally drives the photoconductor drums 41 of the printer 4 also serves as a drive source of the waste developer conveyance mechanism 60 and the bottle driving mechanism 63 (see FIG. 2).

In the present embodiment, the motor 4*a* and the bottle driving mechanism 63 are an example of a driving device that rotationally drives the bottle 5.

The bottle driving mechanism 63 transmits a rotational force of the motor 4*a* to the first end 51 of the bottle 5. The bottle 5 receives the power from the bottle driving mechanism 63 and rotates around the center line LO in a predetermined rotation direction.

By the rotation of the bottle 5 in the predetermined rotation direction, the waste developer 9*x* in the bottle 5 is conveyed to the second end 52 side and leveled along the longitudinal direction of the bottle 5. By the rotation of the bottle 5, the waste developer 9*x* is prevented from being unevenly remained in the bottle 5 on the opening 50 side.

Figure 6:
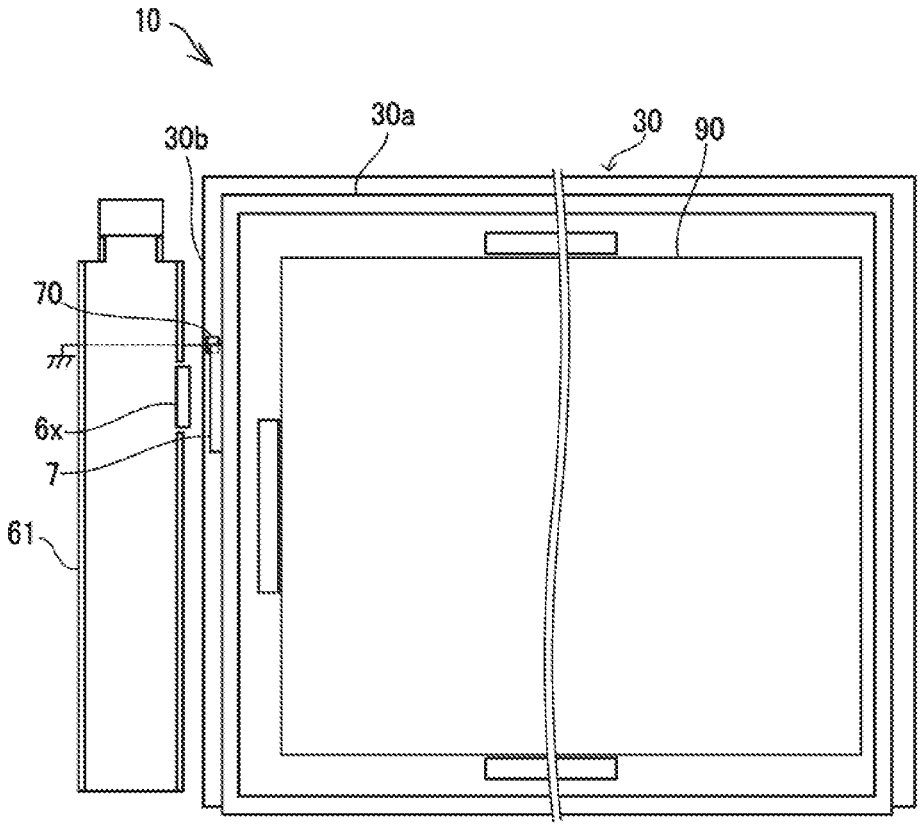
FIG. 6 is a diagram illustrating the bottle attachment part and the sheet storage part in a bottle non-attached state in the image forming apparatus according to the present disclosure.

The bottle 5 is detachably attached to the bottle attachment part 61. When a full state in which the waste developer 9*x* in the bottle 5 has reached the upper limit amount is detected, the bottle 5 is replaced. FIGS. 1, 2, 4, and 5 illustrate a state in which the bottle 5 is attached to the bottle attachment part 61, and FIG. 6 illustrates a state in which the bottle 5 is detached from the bottle attachment part 61.

As shown in FIG. 3, the image forming apparatus 10 further includes a capacitance sensor 6*x*. The detection signal Sg1 of the capacitance sensor 6*x* is input to the CPU 81 of the control device 8.

The capacitance sensor 6*x* is provided on the bottle attachment part 61 and faces to the bottle 5. The capacitance sensor 6*x* detects the amount of the waste developer 9*x* in the bottle 5 by detecting the electrostatic capacity of an opposing area of the bottle 5.

The electrostatic capacity detected by the capacitance sensor 6*x* increases as the amount of the waste developer 9*x* in the bottle 5 increases. Therefore, the level of the detection signal Sg1 of the capacitance sensor 6*x* indicates the amount of the waste developer 9*x* in the bottle 5.

In some cases, the bottle 5 and the capacitance sensor 6*x* are disposed adjacent to the sheet cassette 30*a* in which the sheet 90 can be stored and drawn out. In this case, the detection signal Sg1 of the capacitance sensor 6*x* may vary under the influence of the number of sheets 90 in the sheet cassette 30*a*.

Also in the image forming apparatus 10, the bottle 5 and the capacitance sensor 6*x* for detecting the amount of the waste developer 9*x* in the bottle 5 are disposed adjacent to the sheet cassette 30*a* when the sheet cassette 30*a* is present at the fixed position. In other words, the bottle attachment part 61 is disposed adjacent to the sheet cassette 30*a* when the sheet cassette 30*a* is present at the fixed position.

However, the image forming apparatus 10 includes a configuration for detecting the amount of the waste developer 9*x* without being affected by the number of sheets 90 in the sheet cassette 30*a*. The configuration will be described below.

The capacitance sensor 6*x* is located between the bottle 5 and the sheet cassette 30*a* when the sheet cassette 30*a* is in the fixed position.

As shown in FIGS. 2 and 4 to 6, the image forming apparatus 10 further includes a partition conductor 7 and a relay conductor 70. For example, the partition conductor 7 and the relay conductor 70 are iron, stainless steel, or copper, respectively.

The partition conductor 7 partitions between the sheet 90 in the sheet cassette 30*a*, which is in the fixed position, and the capacitance sensor 6*x*. In the present embodiment, the partition conductor 7 is a plate-shaped metal member. In the present embodiment, the partition conductor 7 is fixed to the sheet cassette 30*a*.

The relay conductor 70 is disposed in the main body 1 and is grounded. Specifically, the relay conductor 70 is electrically connected to the metal housing of the main body 1. In a state where the sheet cassette 30*a* is present in the fixed position, the partition conductor 7 partitions between the sheet 90 in the sheet cassette 30*a* and the capacitance sensor 6*x* and is in contact with the relay conductor 70. That is, the partition conductor 7 is grounded via the relay conductor 70 when the sheet cassette 30*a* is in the fixed position.

Since the grounded partition conductor 7 is interposed between the capacitance sensor 6*x* and the sheet 90 in the sheet cassette 30*a*, the detection signal Sg1 of the capacitance sensor 6*x* is not affected by the number of sheets 90 in the sheet cassette 30*a* and the quality of the sheet 90.

On the other hand, the partition conductor 7 is separated from the relay conductor 70 by the sheet cassette 30*a* being pulled out from the fixed position. Therefore, when the sheet cassette 30*a* is pulled out from the fixed position, the grounding of the partition conductor 7 is released.

When the grounding of the partition conductor 7 is released, the electrostatic capacity detected by the capacitance sensor 6*x* greatly increases beyond the change caused by the bottle 5 being filled with the waste developer 9*x*. That is, the change range of the level of the detection signal Sg1 of the capacitance sensor 6*x* is different between the case where the partition conductor 7 is grounded and the case where the partition conductor 7 is not grounded.

[Processing of CPU 81]

The CPU 81 of the control device 8 includes a state determination unit 8*a* and a device control unit 8*b* which are realized by executing a computer program stored in the secondary storage device 83 (see FIG. 2). The state determination unit 8*a* determines the state of the image forming apparatus 10, and performs a process of notifying the determination result.

The device control unit 8*b* controls various devices including the printer 4 in the image forming apparatus 10. For example, the device control unit 8*b* indirectly controls the waste developer conveyance mechanism 60 and the bottle driving mechanism 63 by controlling the printer 4.

When a predetermined operation condition is satisfied, the device control unit 8*b* operates the motor 4*a* of the printer 4 to operate the waste developer conveyance mechanism 60 and the bottle driving mechanism 63.

Specifically, the operating condition is a condition that is satisfied from the start to the end of the printing process. That is, the operating conditions of the waste developer conveyance mechanism 60 and the bottle driving mechanism 63 in the present embodiment are conditions under which the printer 4 executes the printing process."

For example, the operating condition is satisfied until the printing process corresponding to the print job is completed after the print job which is the execution request of the printing process is generated.

However, the device control unit 8*b* prohibits the printer 4 from executing the printing process when the state determination unit 8*a* determines that the cassette is in the pulled-out state or the full state, which will be described later.

The cassette pulled-out state is a state in which the sheet cassette 30*a* is not in the fixed position. The full state is a state in which the sheet cassette 30*a* is in the fixed position and the amount of the waste developer 9*x* in the bottle 5 has reached a predetermined upper limit amount.

Further, the device control unit 8*b* also prohibits the printer 4 from executing the printing process when the state determination unit 8*a* determines that a bottle non-attached state, which will be described later. The bottle non-attached state is a state in which the sheet cassette 30*a* is in the fixed position and the bottle 5 is not attached to the bottle attachment part 61. The bottle non-attached state is an example of a waste developer container non-attached state.

That is, when the state determination unit 8*a* determines the cassette pulled-out state, the full state, or the bottle non-attached state, the device control unit 8*b* does not cause the printer 4 to execute the printing process even when the operation condition is satisfied.

The state determination unit 8*a* distinguishes and determines the cassette pulled—out state and the full state, based on the detection signal Sg1 of the capacitance sensor 6*x*. In the present embodiment, the state determination unit 8*a* further distinguishes and determines the bottle non-attached state, based on the detection signal Sg1 of the capacitance sensor 6*x*.

Specifically, the state determination unit 8*a* determines that the cassette pulled-out state has occurred when the level of the detection signal Sg1 of the capacitance sensor 6*x* is out of a predetermined effective range.

The effective range is a range in which the level of the detection signal Sg1 can change when the grounded partition conductor 7 faces the surface of the capacitance sensor 6*x* on the side opposite to the bottle 5.

When the level of the detection signal Sg1 is within the effective range and is out of a predetermined allowable range within the effective range, the state determination unit 8*a* determines that the non-attachment state has occurred.

The allowable range is a range in which the level of the detection signal Sg1 can change when the bottle 5 is attached to the bottle attachment part 61 in a state where the grounded partition conductor 7 faces the surface of the capacitance sensor 6*x* on the side opposite to the bottle 5.

When the level of the detection signal Sg1 is within the allowable range, the state determination unit 8*a* determines the amount of the waste developer 9*x* in the bottle 5, based on the level of the detection signal Sg1.

The state determination unit 8*a* determines that the full state has occurred when the level of the detection signal Sg1 is within the allowable range and the electrostatic capacity exceeds a predetermined upper limit electrostatic capacity.

The state determination unit 8*a* notifies the determination result through the display device 802. For example, when the state determination unit 8*a* determines that the cassette pulled-out state has occurred, the state determination unit 8*a* notifies that the sheet cassette 30*a* should be completely mounted. When the state determination unit 8*a* determines that the full state has occurred, the state determination unit 8*a* notifies that the bottle 5 needs to be replaced. When the state determination unit 8*a* determines that the bottle no-attached state has occurred, the state determination unit 8*a* notifies that the bottle 5 should be mounted.

As described above, the image forming apparatus 10 can detect the amount of the waste developer 9*x* without being affected by the number of sheets 90 in the sheet cassette 30*a*. Further, the image forming apparatus 10 can distinguish and detect the pulled-out state and the full state without requiring a dedicated sensor for detecting the pulled-out state of the sheet cassette 30*a*.

That is, the image forming apparatus 10 can detect the amount of the waste developer 9*x* in the bottle 5 and the state of the sheet cassette 30*a* with a small number of sensors. As a result, the number of signal input ports in the CPU 81 of the control device 8 can be reduced. Further, the image forming apparatus 10 can also detect the bottle non-attached state without requiring a dedicated sensor.

According to the present disclosure, when the waste developer container and the capacitance sensor for detecting the amount of the waste developer in the waste developer container are arranged adjacent to the sheet cassette, the provided image forming apparatus can detect the amount of the waste developer without being affected by the number of sheets in the sheet cassette.

What is claimed is:

1. An image forming apparatus comprising:

a sheet cassette configured to accommodate a sheet as a medium on which an image is formed, the sheet cassette being supported so as to be drawable from a predetermined fixed position;

a waste developer container that is disposed adjacent to the sheet cassette when the sheet cassette is located at the fixed position, and stores waste developer;

a capacitance sensor disposed between the waste developer container and the sheet cassette when the sheet cassette is at the fixed position;

a grounded partition conductor that partitions between the sheet in the sheet cassette and the capacitance sensor when the sheet cassette is at the fixed position; and a state determination unit configured to determine an amount of the waste developer in the developer container, based on a detection signal of the capacitance sensor.

2. The image forming apparatus according to claim 1, further comprising a relay conductor that is grounded, wherein the partition conductor is provided in the sheet cassette, and in a state in which the sheet cassette is in the fixed position, partitions the sheet in the sheet cassette and the capacitance sensor, and is in contact with the relay conductor, the sheet cassette is separated from the relay conductor by being pulled out from the fixed position, and the state determination unit determines a cassette pulled-out state in which the sheet cassette is not in the fixed position and a full state in which the sheet cassette is in the fixed position and the waste developer in the waste developer container has reached a predetermined upper limit amount by distinguishing the cassette pulled-out state and the full state, based on the detection signal of the capacitance sensor.

3. The image forming apparatus according to claim 2, further comprising a control unit configured to prohibit a printing process when a determination result of the state determination unit is the cassette pulled-out state or the full state.

4. The image forming apparatus according to claim 2, wherein the waste developer container is detachably attached to an attachment part adjacent to the sheet cassette when the sheet cassette is at the fixed position, and the state determination unit is further configured to determine a container non-attached state in which the sheet cassette is in the fixed position and the waste developer container is not attached to the attachment part by distinguishing the container non-attached state, based on the detection signal of the capacitance sensor.

5. The image forming apparatus according to claim 4, further comprising a control unit configured to prohibit the printing process when a determination result of the state determination unit is the cassette pulled-out state, the full state, or the container non-attached state.

* * * * *